US009238906B2

(12) United States Patent
Schurle

(10) Patent No.: US 9,238,906 B2
(45) Date of Patent: Jan. 19, 2016

(54) WATER-CARRYING LINE SECTION HAVING AN AERATING DUCT

(75) Inventor: Holger Schurle, Mullheim-Feldberg (DE)

(73) Assignee: NEOPERL GMBH, Mullheim (DE)

( * ) Notice: Subject to any disclaimer, the term of this patent is extended or adjusted under 35 U.S.C. 154(b) by 635 days.

(21) Appl. No.: 13/509,872

(22) PCT Filed: Nov. 9, 2010

(86) PCT No.: PCT/EP2010/006815

§ 371 (c)(1),
(2), (4) Date: May 15, 2012

(87) PCT Pub. No.: WO2011/060893

PCT Pub. Date: May 26, 2011

(65) Prior Publication Data

US 2012/0223446 A1 Sep. 6, 2012

(30) Foreign Application Priority Data

Nov. 20, 2009 (DE) ..... 10 2009 054 038

(51) Int. Cl.
*E03C 1/04* (2006.01)
*E03C 1/084* (2006.01)

(52) U.S. Cl.
CPC ..... *E03C 1/0404* (2013.01); *E03C 1/084* (2013.01)

(58) Field of Classification Search
CPC ..... E03C 1/0404; E03C 1/084; F21V 31/03; F16K 24/00; H05K 5/0213
USPC ..... 261/76
See application file for complete search history.

(56) References Cited

U.S. PATENT DOCUMENTS 3,970,731 A * 7/1976 Oksman ..... B01F 3/04262 261/122.1
4,268,279 A * 5/1981 Shindo ..... B01D 53/228 210/321.8

(Continued)

FOREIGN PATENT DOCUMENTS

CH EP 0825810 A1 * 11/1999 ..... H05K 5/0213
DE EP 1239189 A2 * 9/2002 ..... F16H 57/027

(Continued)

OTHER PUBLICATIONS

Translation of DE 102006021801 A1. Translated by Schreiber Translations, Inc. Jul. 2014. Washington, D.C.*

*Primary Examiner* — Duane Smith
*Assistant Examiner* — Stephen Hobson
(74) *Attorney, Agent, or Firm* — Volpe Koenig, P.C.

(57) ABSTRACT

A water-carrying line section having at least one aerating duct (2), the aerating duct (2), on the inlet side, having at least one duct opening (5) open to atmosphere and, on the outlet side, having at least one duct opening (6) that can be flushed by the water flowing past and/or is adjacent thereto, and in which aerating duct (2) a water jet aerator (7) is provided. The line section is characterized in that the water jet aerator (7) has a filtering or separating device (8) which is configured to be permeable to air in the direction from the at least one duct opening (5) on the inlet side toward the at least one duct opening (6) on the outlet side but is impermeable to water in the opposite direction. With the aid of the water jet aerator (7) which is used in the line section (1) and which serves to aerate the water flowing through a sanitary outlet fitting or the like, the undesired emergence of water can be prevented with certainty in any installation situation.

18 Claims, 3 Drawing Sheets

(56) References Cited

U.S. PATENT DOCUMENTS

| | | | | |
|---|---|---|---|---|
| 5,111,994 | A * | 5/1992 | Gonzalez | 239/428.5 |
| 5,670,094 | A * | 9/1997 | Sasaki | B01F 3/0446 261/122.1 |
| 5,752,629 | A * | 5/1998 | Hardy | B05B 11/0021 222/189.09 |
| 6,179,275 | B1 * | 1/2001 | Lagneaux | A61L 9/12 261/104 |
| 7,504,033 | B2 * | 3/2009 | Takagi | B05B 1/16 210/295 |
| 7,878,426 | B2 * | 2/2011 | Denzler | E03C 1/0404 239/398 |
| 8,585,753 | B2 * | 11/2013 | Scanlon | A61F 2/07 623/1.42 |
| 2005/0224406 | A1 * | 10/2005 | Takagi et al. | 210/424 |
| 2007/0090205 | A1 * | 4/2007 | Kunze et al. | 239/338 |
| 2007/0134486 | A1 * | 6/2007 | Bansal et al. | 428/304.4 |
| 2007/0207186 | A1 * | 9/2007 | Scanlon | A61F 2/07 424/424 |

FOREIGN PATENT DOCUMENTS

| | | | | |
|---|---|---|---|---|
| DE | 102006021801 | | 11/2007 | |
| DE | 102006021801 | A1 * | 11/2007 | |
| DE | EP 2273860 | A1 * | 9/2012 | F16H 57/027 |
| EP | 0377067 | | 7/1990 | |
| EP | 1239189 | A2 * | 9/2002 | F16K 57/02 |
| EP | 1739696 | A2 * | 1/2007 | H01H 9/04 |
| EP | 1879439 | A1 * | 1/2008 | H05K 5/02 |
| EP | EP 1879439 | A1 * | 1/2008 | H05K 5/0213 |
| EP | 1313359 | B1 * | 7/2008 | |
| EP | 1739696 | B1 * | 11/2010 | |
| EP | 2273860 | B1 * | 9/2012 | |
| EP | 2280222 | A3 * | 12/2013 | |
| EP | EP 2280222 | A2 * | 12/2013 | F21S 48/335 |
| EP | 2236918 | A3 * | 1/2014 | |
| FR | EP 0579213 | A1 * | 9/1996 | H02B 1/40 |
| IT | EP 0484288 | A1 * | 5/1992 | H05K 5/0213 |
| IT | EP 0764517 | A1 * | 3/1997 | B29C 45/14336 |
| JP | EP 1363484 | A2 * | 6/2007 | F21S 48/335 |
| JP | EP 1313359 | A2 * | 7/2008 | B29C 66/71 |
| JP | EP 1955901 | A1 * | 4/2009 | B65D 77/225 |
| JP | EP 1939523 | A1 * | 5/2010 | F21S 48/335 |
| JP | EP 2236918 | A2 * | 1/2014 | F21S 48/335 |
| WO | 8402547 | | 7/1984 | |

* cited by examiner

WATER-CARRYING LINE SECTION HAVING AN AERATING DUCT

BACKGROUND

The invention relates to a water-conducting line portion which has at least one aeration duct, which aeration duct has, at the inlet side, at least one duct opening open to the atmosphere and, at the outlet side, at least one duct opening which can be flushed around by, and/or is adjacent to, the water flowing past, and in which aeration duct is provided a water jet aerator which has a filtering or separating device which is designed to be permeable to air in the direction from the at least one inlet-side duct opening to the at least one outlet-side duct opening but so as to be impermeable to water in the opposite direction.

Already known from the Applicant's prior application DE 10 2006 021 801 A1 is a water-conducting line portion which is formed as a sanitary outlet fitting and which has an aeration duct at a distance below its water outlet. The aeration duct has, at the inlet side, a duct opening open to the atmosphere, whereas, on the outlet side of the aeration duct, a duct opening is provided which can be flushed around by the water flowing through the outlet fitting. In the aeration duct there is provided a water jet aerator which is designed to be permeable to air in the direction from the inlet-side duct opening to the outlet-side duct opening but so as to be impermeable to water in the opposite direction. The filtering or separating device which is provided in DE 10 2006 021 801 A1, the aim of which filtering or separating device is to prevent an emergence of water during the extraction of water at the outlet fitting, is designed as a one-way aeration valve. Such a one-way aeration valve however possibly cannot completely prevent a situation in which, after the closing of the shut-off valve, a part of the water column which initially remains between the aeration device and the water outlet and which then flows back also passes unintentionally through the one-way aeration valve provided in the aeration device, and becomes visible as a trickle, or as limescale traces resulting from evaporation, on the outside of the outlet fitting.

Already known from EP 0 377 067 A1 is a shut-off device which serves for shutting off sealed housings, which are provided with an aeration and deaeration facility, against an ingress of water. The already known shut-off device has a support body and a non-planar diaphragm formed in the support body. This diaphragm is permeable to gas but impermeable to water. In the support body there are situated, at the outer side, a plurality of liquid outflow ducts arranged such that water which possibly collects on the diaphragm and which collects at certain points owing to the non-planar arrangement of the diaphragm flows off to the outside and thus ensures the permeability of the diaphragm to gas. There is however no suggestion in EP 0 377 067 A1 that this already known shut-off device should also be usable in a water-conducting line portion and in particular on a sanitary outlet fitting.

Already known from DE 10 2006 021 801 A1 is a sanitary outlet fitting which, in a partial region of its fitting housing leading to the water outlet, has a water jet aerator at a distance upstream of the water outlet, the intention of which is to make it possible to dispense with an aerated jet regulator in the water outlet. The water jet aerator of the already-known outlet fitting has an aeration duct which has, at the inlet side, a duct opening open to the atmosphere and, at the outlet side, at least one duct opening which is flushed around by the water flowing past. The duct opening, which is arranged at the outlet side and which opens out in the housing interior of the fitting housing, of the aeration duct is positioned downstream of a perforated area which is arranged transversely with respect to the water flow and the throughflow holes of which split up the inflowing water into a number of individual jets. In the region of said perforated area, the throughflowing water is accelerated such that, on the outflow side of the perforated area, in the region of the outlet-side duct opening of the aeration duct, a negative pressure is generated which causes the ambient air provided for aerating the water jet to be sucked in through the aeration duct. Since, in the assembled state of the already known outlet fitting, the water jet aerator is generally arranged below the fitting outlet, there is the risk that a part of the water column which remains in the fitting housing when the outlet fitting is closed can emerge to the outside through the aeration duct, and can become noticeable on the outside of the outlet fitting in the form of unattractive limescale deposits.

SUMMARY

It is therefore the object in particular to provide a water-conducting line portion having a water jet aerator which, in any installation situation of the outlet fitting, reliably prevents an undesired emergence of water out of the aeration duct.

This object is achieved according to the invention, in the case of the water-conducting line portion of the type mentioned in the introduction, in particular in that the water jet aerator has an installation housing which is designed to be detachably installed into a fitting housing, in that the at least one aeration duct extends through the installation housing, and in that the filtering or separating device of the water jet aerator has a porous diaphragm which has a structure and/or layer which is permeable to air but impermeable to water.

The line portion according to the invention is assigned a water jet aerator which has an installation housing designed to be detachably installed into a fitting housing. Since the water jet aerator has an installation housing which can be detachably inserted into a fitting housing, the fitting housing, usually produced from metal, can be produced separately from the water jet aerator and assembled with the water jet aerator after the production process. It is provided according to the invention that the at least one aeration duct extends through the installation housing. The at least one aeration duct has, at the inlet side, at least one duct opening open to the atmosphere and, at the outlet side, at least one duct opening which can be flushed around by, and/or is adjacent to, the water flowing through the line portion. A filtering or separating device designed as a diaphragm is interposed in said aeration duct. This filtering or separating device is permeable to air in the direction toward the water-conducting housing interior of the fitting housing, and thus allows the ambient air required for aerating the water jet to pass through. The filtering or separating device is however designed to be impermeable to water in the opposite direction, such that under no circumstances can water emerge through the aeration duct and become objectionably noticeable as a result of limescale deposits for example on the outer circumference of the water-conducting line portion, and therefore also on the outside of a sanitary outlet fitting which serves as a line portion. As a result of its selective permeability and its construction, the filtering or separating device can also—depending on the pore size—purify the air sucked in of bacteria or other impurities which could otherwise pass into the outflowing water and from there for example onto the hands or onto food being flushed and which could be of concern from a hygiene aspect.

A preferred embodiment therefore provides that the structure and/or layer which is permeable to air but which is impermeable to water has a polytetrafluoroethylene, polyethylene or polyamide layer or coating, and/or that the porous diaphragm is formed as a fabric or sintered material.

One preferred embodiment provides that the diaphragm is produced from in particular stretched polytetrafluoroethylene or from an open-pored polyester structure.

The diaphragm provided in the filtering or separating device may be formed, for example, as a porous diaphragm which has a structure and/or layer which is permeable to air but impermeable to water. Such diaphragms are for example on the market in the textile industry under the trade name "GORE-TEX".

To slow or completely prevent the blockage of the diaphragm pores, it may be advantageous for the filtering or separating device to have, preferably at the outlet side, at least one nonwoven structure formed as a pre-filter. This nonwoven structure which is arranged at the outlet side and therefore at the water side serves to protect the diaphragm provided in the filtering or separating device. The nonwoven structure arranged preferably at the water side may be provided for example to maintain cleanliness of the porous or gas-permeable foils or layers which serve as a diaphragm.

One preferred embodiment of the invention provides that the filtering or separating device has, preferably at the inlet side, a fabric or similar mechanically stabilizing support structure. This support structure serves to mechanically stabilize the filtering or separating device according to the invention, and the diaphragm provided therein. Furthermore, the support structure may also have an additional filter function.

It is particularly advantageous if the diaphragm is arranged between an outlet-side pre-filter and a mechanically stabilizing support structure arranged at the inlet side.

To favorably influence the filtering or separating device of the water jet aerator provided according to the invention with further product characteristics, it may be advantageous for the filtering or separating device to bear at least one layer for oleophobization and/or microbiological passivation. Here, an embodiment is preferred in which the layer has silver ions.

It is particularly advantageous for the inlet-side support layer and/or the outlet-side pre-filter to be formed as a layer for oleophobization and/or as a layer for microbiological passivation.

One preferred exemplary embodiment is provided in that the water jet aerator is designed to be detachably and preferably exchangeably installed into a fitting housing, which serves as a water-conducting line portion, of a sanitary outlet fitting. It is however also possible for the aeration duct provided for accommodating the water jet aerator used according to the invention to be provided in the circumferential wall of some other water-conducting line portion, for example of a pipe piece. To be able in as simple a manner as possible to interconnect the water jet aerator in the aeration duct provided in a fitting housing or in some other line portion, it is expedient for the water jet aerator to have an installation housing which is designed to be exchangeably installed into the fitting housing of a sanitary outlet fitting, and/or through which the at least one aeration duct extends.

The ambient air situated around the outlet fitting is sucked into the water-conducting housing interior of the fitting housing by the water jet aerator according to the invention, and in the housing interior is mixed with the water passing through. A preferred refinement of the invention thus provides that, in the line portion, there is provided at least one cross-sectional narrowing which, by means of a cross-sectionally induced acceleration of the water flowing through, generates a negative pressure in the region of at least one outlet-side duct opening, and that the cross-sectional narrowing is for this purpose positioned upstream, as viewed in the water flow direction, of said at least one outlet-side duct opening. If the water flowing through the outlet fitting or the line portion is accelerated, then it is possible in accordance with the Bernoulli equation for a negative pressure to be generated which can be used to suck the ambient air through the water jet aerator.

Here, one preferred embodiment of the invention provides that the cross-sectional narrowing provided in the course of the flow has at least one perforated area arranged transversely with respect to the water flow.

Such a perforated area which has a number of throughflow openings constitutes a cross-sectional narrowing which leads to an acceleration of the throughflowing water. To additionally promote an acceleration of the throughflowing water and to additionally increase the negative pressure thereby generated, it is expedient for the perforated area to have a number of throughflow openings which have a larger hole cross section at the inlet side than at the outlet side.

Here, a rapid and quiet acceleration of the water flowing through the perforated area is further promoted if the perforated area has throughflow openings which, at the inlet side, have a hole portion which narrows in the shape of a funnel.

It is possible for at least one diaphragm or similar filtering or separating device to be held in a detachable or non-detachable manner in an installation housing formed preferably as an insert cartridge.

Here, one embodiment of the invention provides that the at least one diaphragm or similar filtering or separating device is snapped into or fixedly connected to, in particular pressed into, adhesively bonded to or welded to, the circumferential edge region bordering the at least one aeration duct. It is expedient here for the filtering or separating device to be sealingly connected to the circumferential edge region bordering the at least one aeration duct.

The manifold functions of the filtering or separating device provided according to the invention can be further promoted if at least one diaphragm and/or a filter preferably positioned upstream at the inlet side is set such that a maximum air quantity can be sucked in per unit time, and/or is designed for purifying the air.

Here, a preferred embodiment of the invention provides that the filtering or separating device is a constituent part of an insert cartridge which can be detachably inserted into the installation housing of the water jet aerator, and that the insert cartridge is preferably accessible from the outside of the installation housing for the purpose of being exchanged.

One particularly advantageous refinement of the invention provides that the installation housing is formed as an in particular cylindrical hollow body which, in the region of its hollow body interior, bears the at least one diaphragm or similar filtering or separating device and which, on its hollow body circumferential wall, has a wall portion which has the throughflow holes formed as a cross-sectional narrowing.

BRIEF DESCRIPTION OF THE DRAWINGS

Refinements of the invention will emerge from the following description and from the claims. The invention will be described in more detail below on the basis of preferred exemplary embodiments.

In the drawings.

DETAILED DESCRIPTION OF THE PREFERRED EMBODIMENTS

Figures 1, 2, 3:
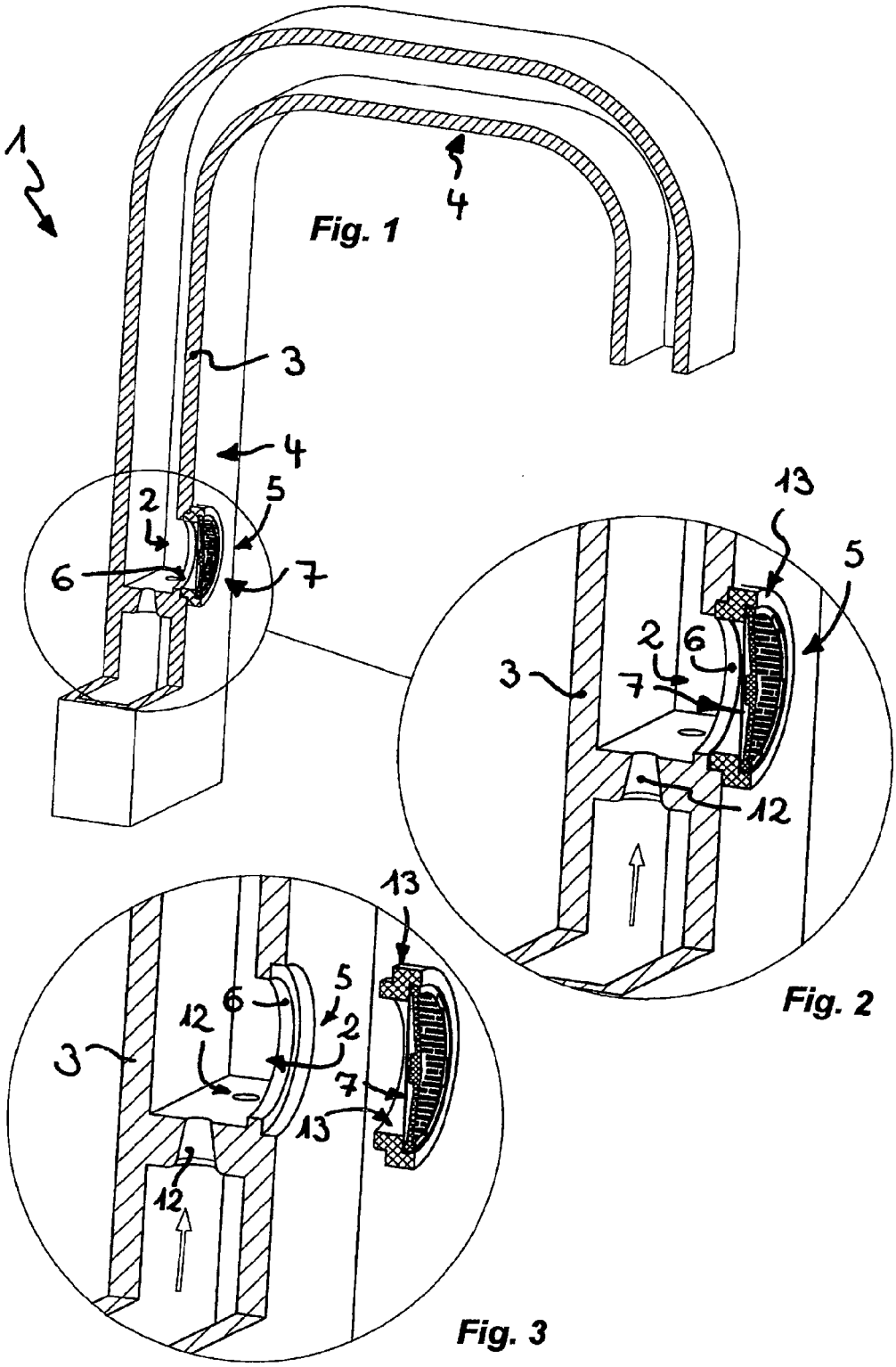
FIG. 1 shows, in a longitudinal sectional view, an outlet fitting which serves as a water-conducting line portion and which has a fitting housing which has an aeration duct into which a water jet aerator can be inserted, which water jet aerator has a filtering or separating device which is permeable to air in the direction of the housing interior of the fitting housing but impermeable to water in the opposite direction.
FIG. 2 shows the outlet fitting from FIG. 1 in a longitudinal sectional detail in the region of its water jet aerator formed as an exchangeable insert cartridge.
FIG. 3 shows the outlet fitting from FIGS. 1 and 2 in a longitudinal sectional detail, with the water jet aerator dismounted from the fitting housing.

FIGS. 1 to 6 show a water-conducting line portion 1 which has an aeration duct. The line portion 1 may be formed as a circumferential wall of a pipe piece or—as is the case here—as a fitting housing 3 of a sanitary outlet fitting 4. The aeration duct 2 provided in the line portion 1 has, at the inlet side, at least one duct opening 5 open to the atmosphere and, at the outlet side, at least one duct opening 6 which can be flushed around by the water flowing past.

A water jet aerator 7 is interposed in the aeration duct 2, which water jet aerator serves to generate an aerated and therefore sparkling, soft water jet. The water jet aerator 7 is to prevent an emergence of water from the water-conducting line portion 1 and at the same time ensure the flow of air through the aeration duct 2.

Figure 7:
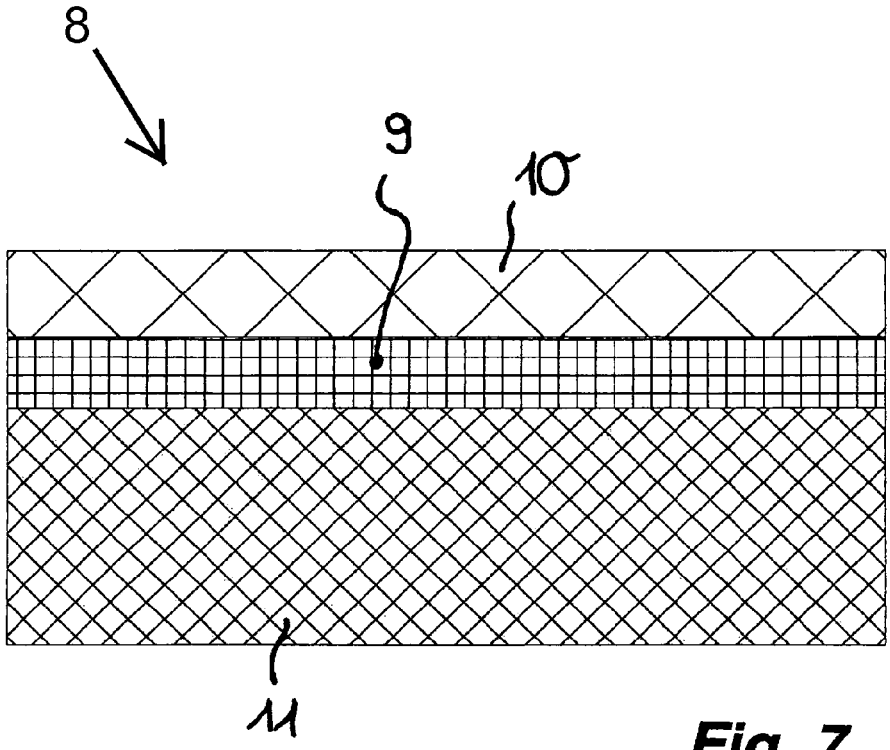
FIG. 7 shows, in a schematic longitudinal sectional detail, the layered construction of the water jet aerator used in FIGS. 1 to 6.

For this purpose, the water jet aerator 7 has a filtering or separating device 8, illustrated in more detail in FIG. 7, which is designed to be permeable to air in the direction from the at least one inlet-side duct opening 5 to the at least one outlet-side duct opening 6, but impermeable to water in the opposite direction. As is clear from the layered construction of the filtering or separating device 8 schematically shown in FIG. 7, this filtering or separating device has a diaphragm 9 which has at least one structure and/or layer which is permeable to air but impermeable to water. This structure and/or layer which is permeable to air but impermeable to water may be in the form of a polytetrafluoroethylene layer or coating, though it is also possible for the diaphragm to be produced from a fabric or a sintered material. An embodiment is preferable in which the diaphragm 9 is produced from in particular stretched polytetrafluoroethylene or from an open-pored polyester structure.

It can also be seen in FIG. 7 that the filtering or separating device 8 has a nonwoven structure 10 which is formed as a pre-filter and which is arranged preferably—as is the case here—at the outlet side and therefore at the water side and which serves to protect the diaphragm 9. In addition or alternatively, the filtering or separating device 8 may also have a fabric or similar mechanically stabilizing support structure 11 which is arranged preferably—as is the case here—at the inlet side and therefore at the air side. As can be seen from FIG. 7, the diaphragm 9 is arranged between the outlet-side pre-filter 10 and the mechanically stabilizing support structure 11 which is arranged at the inlet side.

The support structure 11 provides the filtering or separating device with adequate mechanical stability. This support structure 11 may furthermore have a filter function. One preferred embodiment of the invention provides that the filtering or separating device 8 bears at least one layer for oleophobization and/or microbiological passivation. Here, the support layer 11 and/or the pre-filter 10 may be formed as a layer for oleophobization and/or as a layer for microbiological passivation. Further exemplary embodiments provide that the support structure 11 and/or the nonwoven structure 10 which serves as a pre-filter have a coating which has an anti-bacterial action and which may comprise in particular silver ions.

It can be seen in FIGS. 1 to 6 that, in the line portion 1, there is provided at least one cross-sectional narrowing 12 which, by means of a cross-sectionally induced acceleration of the water flowing through, generates a negative pressure in the region of the outlet-side duct opening 6. To make it possible for ambient air to be sucked from the atmosphere into the water through the aeration duct 2 by means of said negative pressure, the cross-sectional narrowing 12 is positioned upstream, as viewed in the flow direction, of the outlet-side duct opening 6.

Figure 6:
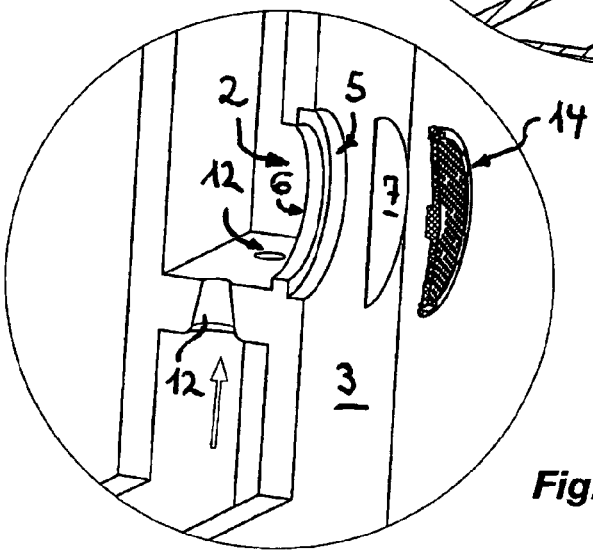
FIG. 6 shows the outlet fitting from FIGS. 4 and 5 in a longitudinal sectional detail, with the water jet aerator dismounted from the fitting housing.

It is clear from FIGS. 3 and 6 that the water jet aerator 7 is designed to be detachably and preferably exchangeably installed into the line portion 1. Here, the water jet aerator 7 illustrated in FIGS. 1 to 3 has an installation housing 13 which is designed to be detachably and preferably exchangeably installed into the aeration duct 2 of the line portion 1. The water jet aerator 7 which has the installation housing 13 and which is illustrated in FIGS. 1 to 3 thus forms an insert cartridge which can be inserted into the fitting housing 3 of the sanitary outlet fitting 4.

On the basis of FIG. 6, exemplary embodiments are conceivable in which the water jet aerator and in particular the separating device thereof is non-detachably connected, for example adhesively bonded or welded, to the fitting housing.

Figure 4:
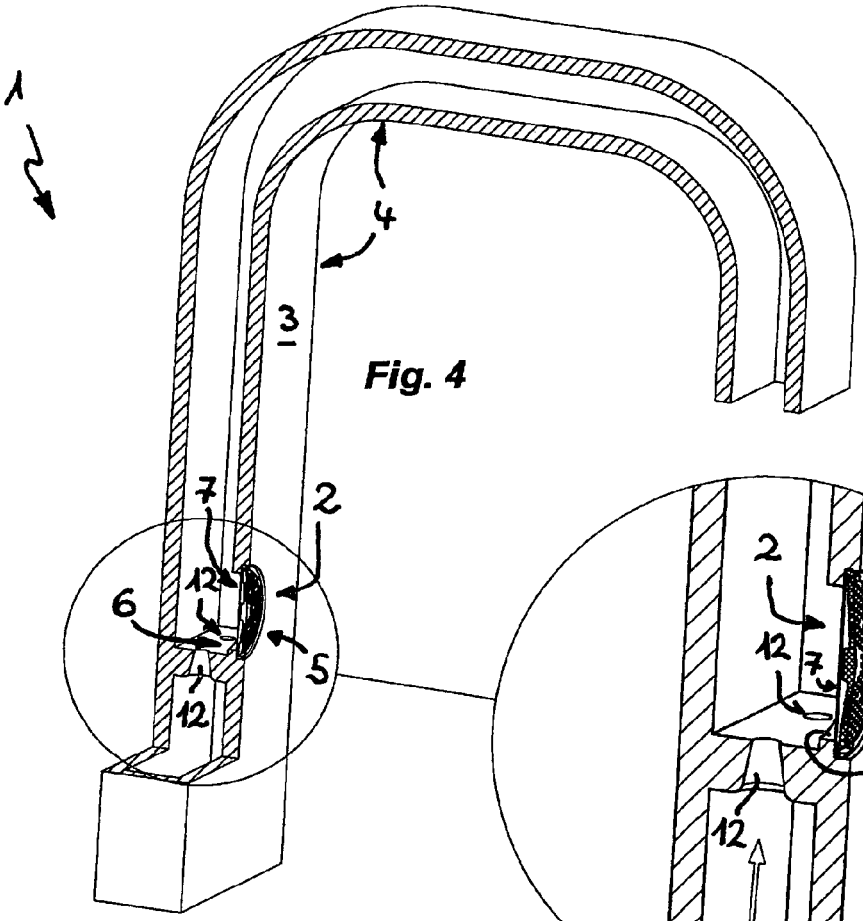
FIG. 4 shows, in a longitudinal sectional view, an outlet fitting which likewise serves as a water-conducting line portion and which corresponds in terms of its basic design to the outlet fitting as per FIGS. 1 to 3, but in which a disk-shaped water jet aerator is inserted in the aeration duct and clamped or secured by means of an upstream or filter screen which additionally offers mechanical protection for the water jet aerator.
Figure 5:
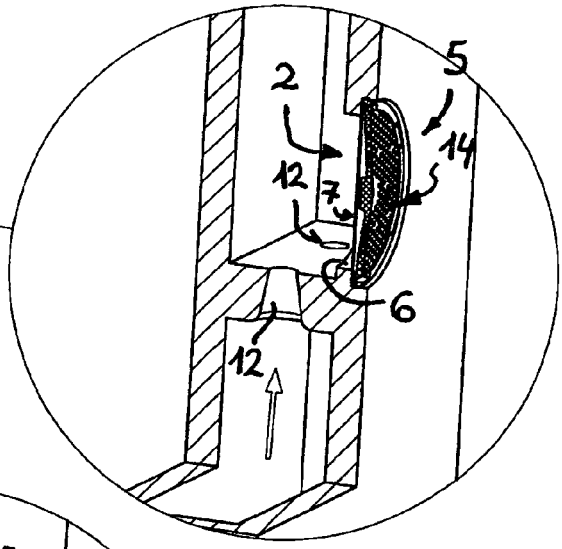
FIG. 5 shows the outlet fitting from FIG. 4 in a longitudinal sectional detail in the region of its disk-shaped water jet aerator.

By contrast, FIGS. 4 to 6 illustrate that the water jet aerator may also be formed as a multi-layer disk which can be inserted into the aeration duct 2 in the fitting housing 3. It is clear from a comparison of FIGS. 1 to 3, on the one hand, and FIGS. 4 to 6, on the other hand, that the preferably multi-layer filtering or separating device 8 can be clamped and secured in the installation housing 13 or directly in the aeration duct 2 by means of an upstream screen 14 or by some other retention means. In FIGS. 1 to 6, the upstream screen 14 also serves to protect the water jet aerator 7 in particular against mechanical damage.

The filtering or separating device 8 with its diaphragm 9 may be non-detachably fixed in, for example adhesively bonded into, welded into, clamped in or snapped into, the aeration duct or else the installation housing 13. By means of a non-detachable connection of said type, it is ensured in particular that the filtering or separating device 8 is sealingly connected to the circumferential edge region bordering the at least one aeration duct 2.

It may be advantageous for the diaphragm 9 and/or a filter positioned upstream at the inlet side to be set such that a maximum air quantity can be sucked in per unit time, and/or designed for purifying the air.

The invention claimed is:

1. A water-conducting line portion (1) comprising at least one aeration duct (2), said at least one aeration duct (2) has at least one inlet-side duct opening (5) open to atmosphere and at least one outlet-side duct opening (6) which can be at least one of: flushed by, or is adjacent to, water flowing past, and a water jet aerator (7) is provided in said at least one aeration duct (2), the water jet aerator (7) has a filtering or separating device (8) which is permeable to air in a direction from the at least one inlet-side duct opening (5) to the at least one outlet-side duct opening (6) but is impermeable to water in an opposite direction, the water jet aerator (7) has an installation housing (13), that is detachably installable into a fitting housing, the at least one aeration duct (2) extends through the installation housing (13), and the filtering or separating device (8) of the water jet aerator (7) has a porous diaphragm (9) which has at least one of a structure or layer which is permeable to air but impermeable to water.

2. The line portion as claimed in claim 1, wherein the porous diaphragm (9), which is permeable to air but impermeable to water has an acrylic, polytetrafluoroethylene, polyethylene or polyamide layer or coating, or the porous diaphragm (9) is formed as a fabric or sintered material.

3. The line portion as claimed in claim 1, wherein the porous diaphragm (9) is produced from stretched polytetrafluoroethylene or from an open-pored polyester structure.

4. The line portion as claimed in claim 1, wherein the filtering or separating device (8) has at least one nonwoven structure (10) formed as a pre-filter.

5. The line portion as claimed in claim 1, wherein the filtering or separating device (8) has a fabric or mechanically stabilizing support structure (11).

6. The line portion as claimed in claim 1, wherein the porous diaphragm (9) is arranged between an outlet-side pre-filter (10) and a mechanically stabilizing support structure (11) arranged at the inlet side.

7. The line portion as claimed in claim 1, wherein the filtering or separating device (8) bears at least one layer for at least one of oleophobization or microbiological passivation.

8. The line portion as claimed in claim 7, wherein the at least one layer for at least one of oleophobization or for microbiological passivation includes silver ions.

9. The line portion as claimed in claim 1, wherein the water jet aerator (7) is detachably installed into the water-conducting line portion.

10. The line portion as claimed in claim 1, wherein in the line portion (1), there is provided at least one cross-sectional narrowing (12) which, by a cross-sectionally induced acceleration of the water flowing therethrough, generates a negative pressure in a region of the at least one outlet-side duct opening, and the at least one cross-sectional narrowing (12) is positioned upstream, as viewed in a flow direction, of said at least one outlet-side duct opening (6).

11. The line portion as claimed in claim 10, wherein the at least one cross-sectional narrowing has at least one perforated area arranged transversely with respect to the water flow.

12. The line portion as claimed in claim 11, wherein the perforated area has a number of throughflow openings which have a larger hole cross section at an inlet side than at an outlet side.

13. The line portion as claimed in claim 10, the perforated area has throughflow openings which, at the inlet side, have a hole portion which narrows in a shape of a funnel.

14. The line portion as claimed in claim 1, wherein the filtering or separating device is held in a detachable or non-detachable manner in the installation housing (13) or in the fitting housing (1).

15. The line portion as claimed in claim 1, wherein the filtering or separating device (8) is snapped into or fixedly connected to a circumferential edge region bordering the at least one aeration duct (2).

16. The line portion as claimed in claim 15, wherein the filtering or separating device is sealingly connected to the circumferential edge region bordering the at least one aeration duct (2).

17. The line portion as claimed in claim 1, wherein at least one of: the porous diaphragm (9) or a filter positioned upstream at the inlet side is set such that a predetermined maximum quantity of air can be sucked in per unit time, or is configured to purify the air.

18. The line portion as claimed in claim 1, wherein the installation housing is formed as a cylindrical hollow body which, in a region of a hollow body interior thereof, bears in each case at least one of the porous diaphragms (9) or the filtering or separating device (8) and which, on a hollow body circumferential wall thereof, has a wall portion which has at least one throughflow opening formed as a cross-sectional narrowing.

* * * * *